US005499944A

United States Patent [19]

Weston et al.

[11] Patent Number: 5,499,944

[45] Date of Patent: Mar. 19, 1996

[54] CURRENCY HANDLING APPARATUS

[75] Inventors: John A. Weston; John W. Bailey, both of Reading, United Kingdom

[73] Assignee: Mars Incorporated, McLean, Va.

[21] Appl. No.: 374,653

[22] PCT Filed: Jul. 30, 1993

[86] PCT No.: PCT/GB93/01622

§ 371 Date: Jan. 27, 1995

§ 102(e) Date: Jan. 27, 1995

[87] PCT Pub. No.: WO94/03874

PCT Pub. Date: Feb. 17, 1994

[30] Foreign Application Priority Data

Jul. 30, 1992 [GB] United Kingdom ..... 9216172

[51] Int. Cl.[6] ..... G07D 1/06

[52] U.S. Cl. ..... 453/17; 194/216; 453/20

[58] Field of Search ..... 453/17, 20; 194/216, 194/217, 218

[56] References Cited

U.S. PATENT DOCUMENTS 4,883,158 11/1989 Kobayashi et al. ..... 194/217

FOREIGN PATENT DOCUMENTS

| | | | |
|---|---|---|---|
| 0076640 | 4/1983 | European Pat. Off. . | |
| 0167181 | 1/1986 | European Pat. Off. . | |
| 0484824 | 5/1992 | European Pat. Off. . | |
| 0520622 | 12/1992 | European Pat. Off. . | |
| 2364844 | 4/1978 | France . | |
| 4101949 | 7/1992 | Germany | 453/17 |
| 1415162 | 11/1975 | United Kingdom . | |
| 2140954 | 12/1984 | United Kingdom . | |
| 2161007 | 1/1986 | United Kingdom . | |

*Primary Examiner*—F. J. Bartuska
*Attorney, Agent, or Firm*—Fish & Richardson

[57] ABSTRACT

A coin handling apparatus can operate in either one of two modes. In a first mode, coins are delivered to containers unless a predetermined maximum level T has been reached. When a serviceman services the machine, each container is automatically emptied to a predetermined, alterable float level FD. The emptied coins and the coins in the cashbox are then removed by the serviceman. In a second mode, coins are delivered to containers until the numbers stored in the containers correspond to predetermined, alterable upper levels FU. The containers are replenished to these levels when a serviceman services the machine. Each of the levels FU and FD can be periodically altered on the basis of a calculated likelihood that coins will be required for change.

14 Claims, 2 Drawing Sheets

FIG. 2
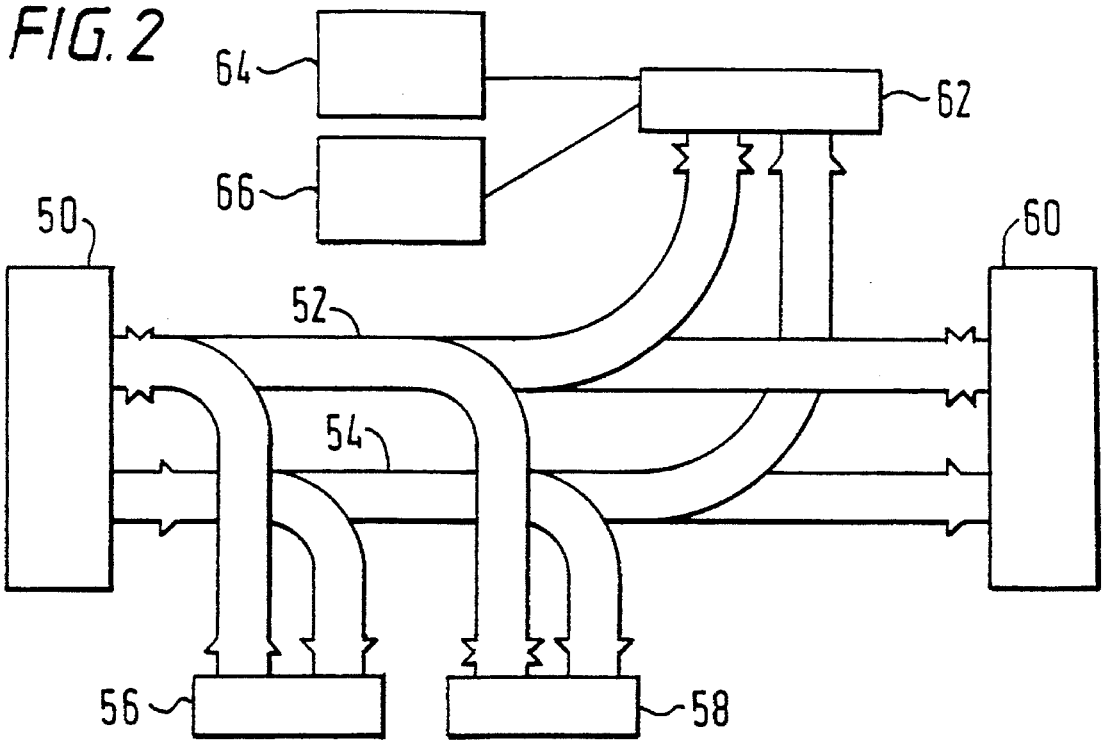
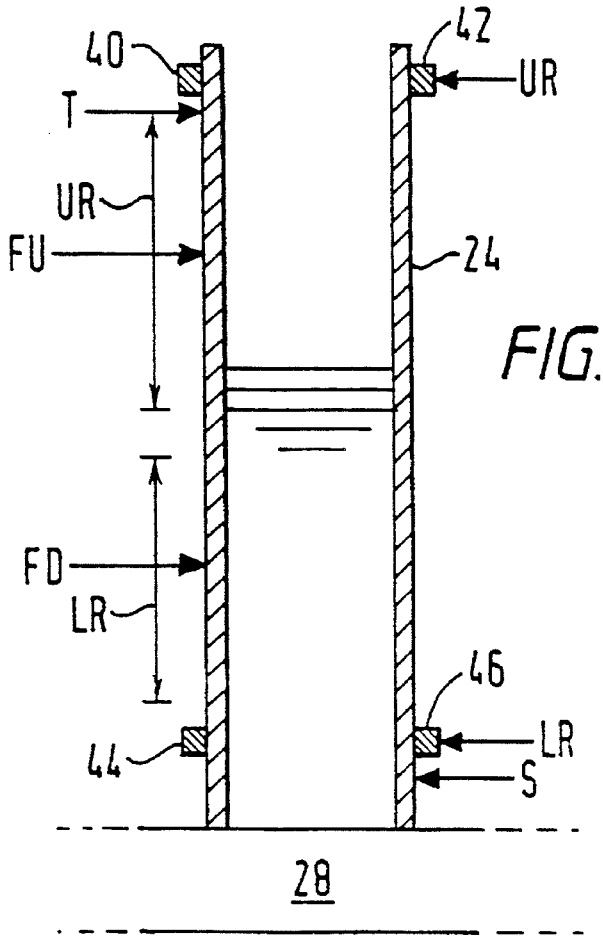
FIG. 3

CURRENCY HANDLING APPARATUS

FIELD OF THE INVENTION

This invention relates to apparatus for handling units of currency. The invention will be described mainly in the context of coin handling, but is also applicable to apparatus which also or alternatively handles other units of currency, such as banknotes.

BACKGROUND OF THE INVENTION

It is known to provide a coin handling apparatus which receives and validates coins of different denominations, and directs valid coins to respective containers each containing coins of a single denomination. It is also known to dispense coins from these containers as change in an amount corresponding to the difference between the value of inserted coins and the price of a product or service obtained from a machine associated with the coin handling apparatus.

It is also known to arrange for the level of coins in each container not to exceed a predetermined upper level. The apparatus would thus tend to direct coins of a particular denomination to an associated container until the upper level is reached, and then any further coins of the same denomination would be sent to a cashbox, which would normally be of a type which does not permit the dispensing of coins therefrom.

Periodically, an operator will empty the cashbox. At this time, it is common for operators to adjust the levels of coins in the coin containers so that each one will contain a number of coins corresponding to a so called "float" level for the respective container. Adjustable markers may be provided to indicate these float levels.

An apparatus of this type substantially continuously stores large amounts of currency in the containers. This ensures that there is usually an adequate supply of coins in the container to be used as change if this is necessary. The float levels may be decreased to release cash to the machine owner, but then less cash is available for giving change to a user of the machine, and therefore there is a greater risk that insufficient change will be available.

In other situations, servicemen do not adjust the levels in the containers when emptying the cashbox. It is then possible for large amounts of money to be continuously stored in the containers, particularly those containers which contain high-denomination coins which are not often dispensed as change.

In some arrangements (see EP-0 076 640-B) it is possible to adjust the predetermined upper level of a container, so as to reduce the maximum number of stored coins. The apparatus will store less currency, which is beneficial to the owner of the machine.

The present invention aims to improve these known arrangements.

SUMMARY OF THE INVENTION

According to a first aspect of the invention, there is provided currency handling apparatus comprising at least one store for storing units of currency, means for selectively directing currency units to the store and means for selectively dispensing units from the store, characterised by control means which can be enabled by an operator automatically to empty the container to a predetermined, adjustable float level.

It is intended that a serviceman would periodically empty the apparatus, by operating a control means to empty the or each container to the respective float levels (which in the preferred embodiment causes the emptied coins to be delivered to the cashbox), and then by emptying the cashbox itself. A large amount of cash can therefore be removed from the machine without requiring careful adjustment operations by the serviceman, with the consequent possibility of errors. Thereafter, the containers are replenished during normal use of the machine.

A preferred feature of the invention minimises the risk that, in the period following servicing of the machine, there will be insufficient coins available for change. It has been found that it is possible, by arranging for the apparatus to monitor certain parameters, to calculate dynamically the likelihood that a particular denomination will be required for dispensing. According to this preferred feature, the predetermined float level is automatically adjustable in response to one or more parameters indicative of the likelihood of the coins being required for change. The parameters may include data indicative of the relative populations of coins of different denominations, either throughout the country in which the apparatus is being used or in a local region in which the apparatus is used. Coins which are more numerous will be more likely to be inserted into the apparatus and less likely to be needed in large quantities as change in the period immediately after servicing the machine.

The parameters may also take into account the prices of products vended or services performed in exchange for cash received by the apparatus. If for example the price of a product is slightly less than a unit of currency, there is a substantial likelihood that the apparatus will be required to pay out the difference in change. The parameters may also take into account the relative popularity of different products or services.

As a more direct indication of the likely need for change, the parameters may include data representing the rate at which coins are received by the machine and/or the rate at which coins are dispensed by the machine. The difference between these two numbers for a particular denomination indicates whether coins of that denomination are likely to be dispensed from or delivered to the respective container.

The parameters may additionally or alternatively relate to the way in which coins of a particular denomination have been handled, e.g. whether they have been predominantly routed to the cashbox or to a container. This will vary depending upon whether the container is tending either to stay full or to be frequently depleted by providing change.

Thus, a preferred embodiment may be arranged to use any one or more of the following parameters:

(a) data indicative of the relative population levels of respective currency denominations in the area in which the apparatus is to be used;

(b) the number of currency units of a particular denomination which have been received by the apparatus;

(c) the number of currency units of a particular denomination which have been dispensed by the apparatus;

(d) the way in which currency units of a particular denomination have been routed by the apparatus;

(e) the or each denomination which can be dispensed by the apparatus; and (f) price data representative of the price of products or services obtained by supplying currency units to said apparatus.

It will be noted that these parameters are interrelated. Any other monitorable parameter bearing a direct or indirect relationship to one or more of these parameters may be used.

In a further aspect of the invention this technique, whereby the machine automatically assesses the likely requirement for currency units to be provided as change, is applied to the known technique of controlling the supply of currency units in dependence on whether or not a predetermined upper level has been exceeded, and is used to adjust this predetermined upper level.

In accordance with the second aspect, there is provided currency handling apparatus comprising a store for storing units of currency, means for dispensing currency units from the store, and means for selectively directing currency units to the store in dependence on whether or not a value indicative of the number of units in the store exceeds a predetermined upper level, characterised by means for automatically adjusting the upper level in response to one or more parameters indicative of the likelihood of the currency units being required for dispensing.

This aspect of the invention is advantageous as compared with prior art techniques, because it optimizes the upper level taking into account the desire to reduce the amount of cash continuously held by the machine while increasing the amount available for change.

BRIEF DESCRIPTION OF THE DRAWING

An arrangement embodying the invention will now be described by way of example with reference to the accompanying drawings, in which:

FIG. 2 is a block diagram of the circuit of the coin handling apparatus; and FIG. 3 is a diagram of one of the containers of the apparatus.

DETAILED DESCRIPTION

Figure 1:
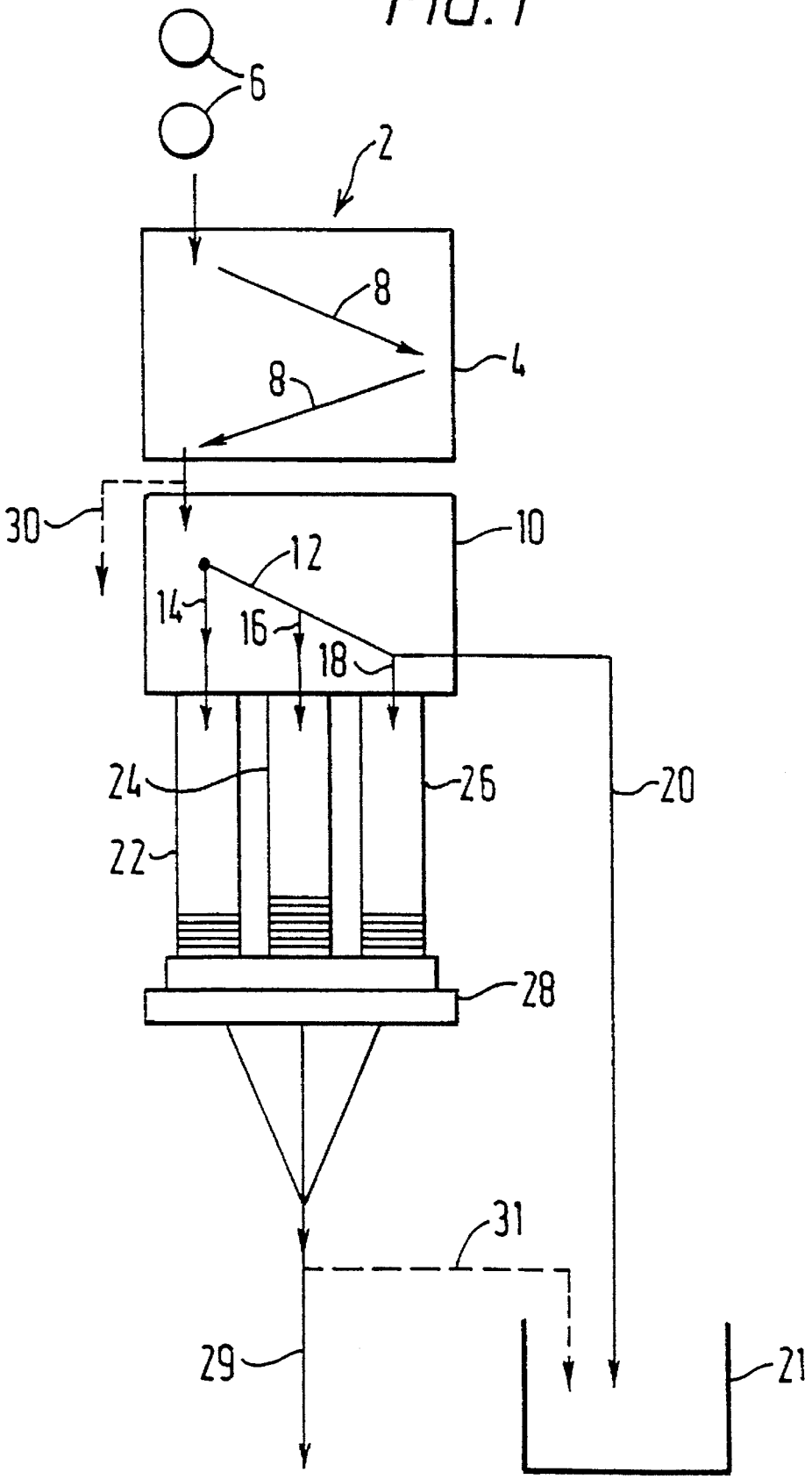
FIG. 1 is a schematic diagram of the mechanical part of a coin handling apparatus in accordance with the invention.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox 21. If the coins are unacceptable, instead of entering the separator 10 they are led straight to a reject slot via a path 30.

Each of the paths 14, 16 and 18 leads to a respective one of three coin tubes or containers 22, 24 and 26. Each of these containers is arranged to store a vertical stack of coins of a particular denomination. Although only three containers are shown, any number may be provided.

A dispenser indicated schematically at 28 is operable to dispense coins from the containers when change is to be given by the apparatus. The dispensed coins are delivered to a refund path 29.

Referring to FIG. 2, the circuit of the present embodiment of the invention incorporates a microprocessor 50 connected to data and address buses 52 and 54. Although separate buses are shown, data and address signals could instead be multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 may also be connected via the buses 52 and 54 to an EAROM 60 for storing a variety of alterable parameters.

The microprocessor 50 is also coupled via the buses 52 and 54 to input/output circuitry indicated at 62. The circuitry 62 includes user-operable switches, at least one level sensor for each of the coin containers 22, 24 and 26, circuits for operating the dispenser 28 and the gates of the coin separator 10, the circuitry of the coin validator 4, and a display visible to a user of the apparatus for displaying an accumulated credit value and an indication when insufficient coins are stored to guarantee that change will be available.

The input/output circuitry 62 also includes an interface between the control circuit of the apparatus and a vending machine 64 to which it is connected, and a further interface to an audit device 66.

In operation of the apparatus the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change. The audit device 66 maintains a record of the number of coins of each denomination received and dispensed by the apparatus.

The arrangement so far is quite conventional, and the details of particular structures suitable for using as various parts of the mechanism will therefore not be described in detail.

The particular sequence of most of the operations carried out by the microprocessor may be the same as in previous apparatus. A suitable program to be stored in the ROM 56 can therefore be designed by anyone familiar with the art, and accordingly only the operations carried out by the particularly relevant parts of this program will be described.

The present embodiment consists of a modification of the arrangement described in connection with EP-0 076 640-B. As in the arrangement disclosed therein, the microprocessor is arranged to maintain counts representing the numbers of coins in the respective containers 22, 24 and 26. Each count is updated in response to further coins being delivered to or dispensed from the respective container.

One of the containers is shown schematically in FIG. 3. Although FIG. 3 shows the container 24, the other containers are substantially identical. The container has an upper level sensor and a lower level sensor. The upper level sensor in this embodiment is an optical sensor comprising a light-emitting device 40, and a light responsive sensor 42. Similarly, the lower sensor comprises a light emitting device 44 and a sensor 46. If the level of coins in the container reaches either of the level sensors, the light path from the respective device to the sensor will be obscured, and this is detected by the microprocessor. Whenever the level of coins changes in such a manner as to block or open the light path of a respective sensor, the coin count for that container is, if necessary, corrected in a predetermined manner, in a way which is analogous to the technique used for the single sensor described in EP-0 076 640-B. If desired, a single level sensor could be used in the present embodiment in place of the upper and lower level sensors.

When the level of coins rises so that the upper level sensor light path has just become blocked, the coin count is set to a value UR which, as indicated in FIG. 3, represents the level of the upper sensor. Similarly, if the level of coins drops so that the light path of the lower sensor is cleared, the coin count for the container is set to a value equal to the lower level sensor level LR (as indicated in FIG. 3) minus 1.

The values UR and LR may be alterable values, for example stored in the EAROM 60. The values LR and UR would for example be altered if the container were to be used for different denomination coins having different thicknesses, so that the number of coins required to reach the lower or upper level sensor would be different.

The microprocessor 50 is operable to allow coins to be dispensed from the container 24 whenever the coin count exceeds a predetermined level S, which is preferably less than LR, and which may also be an alterable value stored in the EAROM 60. The value S may be set to zero, although in the preferred embodiment it is set to a small number because it is found that dispensing of coins becomes less reliable as the last few coins from a container are being dispensed.

The circuitry 62 includes one or more switches which can be operated by a serviceman to select between two modes of the apparatus. These modes are referred to herein as the "float up" mode and the "float down" mode.

In the float up mode, any coins of a denomination stored by the container 24 are directed to the tube 24 unless the number of coins in the tube is equal to or greater than an upper level FU. FU is a variable value, preferably stored in the EAROM 60. This may be varied by, for example, a serviceman, or may be varied in another way to be described later. A typical range over which the level FU may vary is indicated at UR in FIG. 3. It will be noted that this range extends over a substantial proportion of the upper part of the container 24. FU should not exceed a maximum limit T, above which jamming of the apparatus may occur. This level T may also be an alterable parameter, for example stored in EAROM 60. The level T is preferable at or slightly below the level UR of the upper sensor. The upper sensor would be brought into use if the tube is manually refilled to a level exceeding the upper level sensor.

In this mode of operation, whenever a serviceman services the machine, the cashbox 21 is emptied. Each of the coin containers is preferably then replenished until the level of coins reaches FU. Lowering the value of FU thus reduces the amount of cash stored in the machine, but also reduces the amount of change available for dispensing.

Periodically, for example once a week, the microprocessor 50 is operable to use data stored by the audit device 66 to alter the level FU. For example, the microprocessor may use the total number NRT of coins received by the apparatus which are stored in the container 24, and the total number NRC of coins of the same denomination which are routed to the cashbox. The microprocessor then may be arranged to calculate a new upper level FU using an algorithm, for example similar to the following:

$$FU=(UR_{min}+UR_{max})/2+(NRT-NRC)/(NRT+NRC)\times C$$

wherein $UR_{min}$ and $UR_{max}$ correspond to the lower and upper limits of the range UR in which the value FU will typically lie and C is a weighting coefficient which determines how much the value FU shifts in response to a particular difference between the number of coins received by the container and the number of coins received by the cashbox.

Using such an algorithm, it will be appreciated that if the number of coins dispensed is large, coins are more likely to be routed to the container 24, and thus the upper level FU will be set at a higher level so as to maximise the opportunity to provide change. If however the number of coins dispensed is small, the container will fill and the coins will then be directed to the cashbox. The level FU is thus set at a low level, which reduces the amount of cash retained in the machine.

When a serviceman services the machine, he empties the cashbox and feeds coins into the machine until they are rejected because all the containers are filled to their respective upper levels. If desired, this could be done after the serviceman has operated switches to put the machine into a float mode. In this mode, the insertion of coins does not influence the records of genuine transactions kept by the audit device 66.

In the float down mode, the microprocessor allows coins to be directed to the container 24 so long as the number of coins in the tube does not exceed the maximum number T.

When a serviceman services the machine, he operates a particular combination of switches in the circuitry 62 which causes an automatic dispensing action whereby coins are successively dispensed from the container until the level decreases to a predetermined float level FD. The value FD is a variable which may also be stored in the EAROM 60. The value may be stored in the same memory location as is used to store the value FU, the stored value representing FU in the float up mode and FD in the float down mode.

Preferably, this service operation also takes place in a float mode, so that servicing operations do not influence the audit records of genuine transactions. Also, the float mode may cause the microprocessor to inhibit the delivery of coins to the containers unless the level in the container is below FD. This would permit the serviceman to replenish any containers with lower levels in an automatic manner, the microprocessor automatically rejecting or directing to the cashbox any surplus coins fed to the containers.

FIG. 3 shows at LR a typical range over which the value FD may vary. It will be noted that this is located near the bottom of the container 24, but this is not necessary and the range could extend over a higher area, and could overlap the range UR.

Preferably, as the coins are being automatically dispensed, a gate (not shown) is operated either manually or automatically so that the coins are not refunded to the user along path 29 (FIG. 1) but are instead delivered along a path 31 to the cashbox 21.

After the automatic dispensing operation has taken place using all the containers, the cashbox 21 is emptied. This mode thus has the advantage that the total amount of cash retained in the machine is reduced.

Periodically, the microprocessor recalculates the value FD using information from the audit device 66, in a similar way to the recalculation of FU. For example the following algorithm may be used:

$$FD=(LR_{min}+LR_{max})/2+(NRT-NRC)/(NRT+NRC)\times c$$

wherein $LR_{min}$ and $LR_{max}$ correspond to the lower and upper limits of the range LR in which the value FD will typically lie and c is a weighting coefficient which determines how much the value FD shifts in response to a particular difference between the number of coins received and the number of coins dispensed.

Switch means may be provided for disabling the recalculation of the value FU and/or FD.

In an alternative embodiment, there is provided a means, such as a further microprocessor, for carrying out the recalculation of FU and/or FD separately from the microprocessor 50. This recalculating means may be supplied separately from the apparatus, for connection thereto as an optional accessory. It may form part of the audit device 66, which itself may be provided as a separate, connectable device.

It would also be possible to provide a machine which can operate simultaneously in a float up mode (wherein coins are delivered to containers until the level reaches FU) and in a float down mode (wherein coins are dispensed in response to a command from an operator until the level decreases to FD).

In the above arrangement recalculation of FU or FD takes place periodically and automatically. Instead, recalculation may take place in response to a manually-effected instruction, e.g. from a serviceman.

In an alternative embodiment, recalculation occurs in response to a particular event, e.g. when a particular low level of currency units is reached. Instead of calculating an absolute level, an incremental change in the current level can be used. Accordingly, FU or FD could be decreased by a particular amount (e.g. 1) responsive to a low level being reached, and increased responsive to a high level being reached. Preferably a timing means and/or a counting means is used so that changes occur only after a predetermined interval and/or number of events. This arrangement avoids the need to use audit data from audit device 66.

We claim:

1. Currency handling apparatus comprising at least one store for storing units of currency, means for selectively directing currency units to the store, means for selectively dispensing units from the store, control means which can be enabled by an operator automatically to empty the store to a predetermined, adjustable float level, and means for automatically altering said predetermined float level in response to one or more parameters indicative of the likelihood of the currency units being required for dispensing.

2. Apparatus as claimed in claim 1, including a cashbox, the means for selectively directing currency units being operable to direct the units selectively either to the store or to the cashbox.

3. Apparatus as claimed in claim 2, including means for directing the currency units emptied from the store by the control means to the cashbox.

4. Apparatus as claimed in claim 1, wherein the altering means is responsive to at least one of the following parameters:

(a) data indicative of the relative population levels of respective currency denominations in the area in which the apparatus is to be used;

(b) the number of currency units of a particular denomination which have been received by the apparatus;

(c) the number of currency units of a particular denomination which have been dispensed by the apparatus;

(d) the way in which currency units of a particular denomination have been routed by the apparatus;

(e) the or each denomination which can be dispensed by the apparatus; and (f) price data representative of the price of products or services obtained by supplying currency units to said apparatus.

5. Apparatus as claimed in claim 4, wherein the means for adjusting the predetermined float level is operable to adjust the level in response to a relationship between the number of received coins which have been directed to the store, and the number of received coins of the same denomination which have not been directed to the store.

6. Apparatus as claimed in claim 1, the apparatus comprising a plurality of stores each for storing currency units of a respective denomination, the control means being operable automatically to empty each store to a respective predetermined float level.

7. Apparatus as claimed in claim 6, wherein the altering means is operable to alter at least a plurality of said float levels.

8. Apparatus as claimed in claim 1, the apparatus being operable in a first mode, in which the control means can be enabled by an operator automatically to empty the store to said predetermined float level, and in a second mode, in which said directing means is operable to direct currency units to the store on condition that a detected level of currency units in the store does not exceed a predetermined, adjustable upper level.

9. Apparatus as claimed in claim 8, including means for storing a value which in the first mode of the apparatus represents the predetermined float level, and in the second mode represents the predetermined upper level.

10. Apparatus as claimed in claim 8, including means for automatically altering said predetermined upper level in response to one or more parameters indicative of the likelihood of the currency units being required for dispensing.

11. Currency handling apparatus comprising a store for storing units of currency, means for dispensing currency units from the store, means for selectively directing currency units to the store in dependence on whether a value indicative of the number of units in the store exceeds a predetermined upper level, and means for automatically adjusting the upper level in response to one or more parameters indicative of the likelihood of the currency units being required for dispensing.

12. Apparatus as claimed in claim 11, wherein the altering means is responsive to at least one of the following parameters:

(a) data indicative of the relative population levels of respective currency denominations in the area in which the apparatus is to be used;

(b) the number of currency units of a particular denomination which have been received by the apparatus;

(c) the number of currency units of a particular denomination which have been dispensed by the apparatus;

(d) the way in which currency units of a particular denomination have been routed by the apparatus;

(e) the or each denomination which can be dispensed by the apparatus; and (f) price data representative of the price of products or services obtained by supplying currency units to said apparatus.

13. Apparatus as claimed in claim 11, wherein the means for adjusting the predetermined upper level is operable to adjust the level in response to a relationship between the number of received coins which have been directed to the store, and the number of received coins of the same denomination which have not been directed to the store.

14. Apparatus as claimed in claim 11, the apparatus comprising a plurality of stores each for storing currency units of a respective denomination, said directing means being operable to selectively direct currency units of different denominations to the respective stores in dependence on whether the number of currency units in each store exceeds a respective predetermined upper level, and wherein said adjusting means is operable to adjust at least a plurality of said upper levels.

* * * * *